United States Patent [19]

Mugele

[11] 3,973,865

[45] Aug. 10, 1976

[54] SIDE-CHANNEL RING COMPRESSOR

[75] Inventor: Kurt Mugele, Erlangen, Germany

[73] Assignee: Siemens Aktiengesellschaft, Munich, Germany

[22] Filed: Jan. 23, 1975

[21] Appl. No.: 543,542

[30] Foreign Application Priority Data

Feb. 7, 1974 Germany ..... 2405890

[52] U.S. Cl. ..... 415/53 T; 415/119; 415/213 T

[51] Int. Cl.[2] ..... F04D 5/00

[58] Field of Search ..... 415/53 T, 119, 213 T; 417/64; 416/132, 140

[56] References Cited

UNITED STATES PATENTS

| | | | |
|---|---|---|---|
| 1,116,851 | 11/1914 | Schneible | 415/141 |
| 3,006,603 | 10/1961 | Caruso et al. | 415/119 |
| 3,109,580 | 11/1963 | Kentfield | 417/64 |
| 3,202,343 | 8/1965 | Emmermann et al. | 415/141 |
| 3,232,173 | 2/1966 | Van Sittert et al. | 415/119 |
| 3,355,095 | 11/1967 | Hollenberg | 415/213 T |
| 3,556,680 | 1/1971 | Leutwyler | 417/64 |

FOREIGN PATENTS OR APPLICATIONS

| | | | |
|---|---|---|---|
| 1,382,230 | 11/1964 | France | 415/53 T |

*Primary Examiner*—C. J. Husar
*Attorney, Agent, or Firm*—Kenyon & Kenyon Reilly Carr & Chapin

[57] ABSTRACT

The invention concerns a side-channel ring compressor in which the product of the number of blades and the speed of revolution of the impeller is chosen so that the vibrations of the medium to be pumped, which vibrations occur at the inlet and outlet openings of the compressor, are in the supersonic range.

3 Claims, 3 Drawing Figures

SIDE-CHANNEL RING COMPRESSOR

BACKGROUND OF THE INVENTION

1. Field of the Invention

The invention concerns a side-channel ring compressor for pumping and compressing gaseous and/or vaporous media in a vacuum and/or in the overpressure range.

2. Description of the Prior Art

Ring compressors for pumping gases and vapors are known in various designs. The medium to be pumped flows through the compressor on a helical path and, through repeated acceleration, pressure increases are achieved which are 10 to 15 times higher than those achievable with conventional radial blowers of the same dimensions and speed.

A particular problem with such ring compressors is the formation of noise at the inlet and outlet openings. Typically, such noise is suppressed by sound absorbers which are installed in the ring compressors. In isolated critical cases as, e.g., in cases where ring compressors which run continuously are located directly next to operating personnel, the sound level must frequently be further reduced by using an additional sound absorber. Sound absorbers of the aforementioned type are described, for instance, in the German Pat. No. 1,884,542.

It is therefore an object of the present invention to create a side-channel ring compressor in which separate additional sound deadening devices or absorbers for sound reduction can be largely dispensed with.

SUMMARY OF THE INVENTION

According to the present invention, the above and other objectives are accomplished by choosing the product of the number of blades and the operating speed of the impeller of the compressor in such a way that the vibration maxima of the pumped medium at the suction (inlet) and pressure (outlet) openings of such compressor have a frequency which lies above the threshold frequency of hearing of the human ear and below 100 kHz.

The aforesaid design criteria is based on the discovery, which is also documented by tests, that the maxima of the sound pressure level are given by the product of the speed and the number of blades of the compressor impeller. Thus, at a speed of about 3000 r.p.m. and with about 40 blades, the maxima of the vibration frequency are at about 2000 Hz. Accordingly, quieter operation would be obtained in the latter case if, for instance, the number of blades was made 10 times larger, thereby driving the vibration maxima to a frequency of 20 kHz.

In a pump of the present design, a conventional three-phase drive with, for instance, 3000 r.p.m. can be used if the number of blades is chosen very high.

Instead of, or in addition to, increasing the number of blades, it is also very advantageous in many cases to increase to operating speed of the impeller, e.g., by special drives such as electronic motors, beyond the speeds which are obtained when normal, line-connected three-phase motors are used.

BRIEF DESCRIPTION OF THE DRAWING

The invention will be explained in further detail in the following description which makes reference to the accompanying drawing, in which.

DETAILED DESCRIPTION

Figure 1:
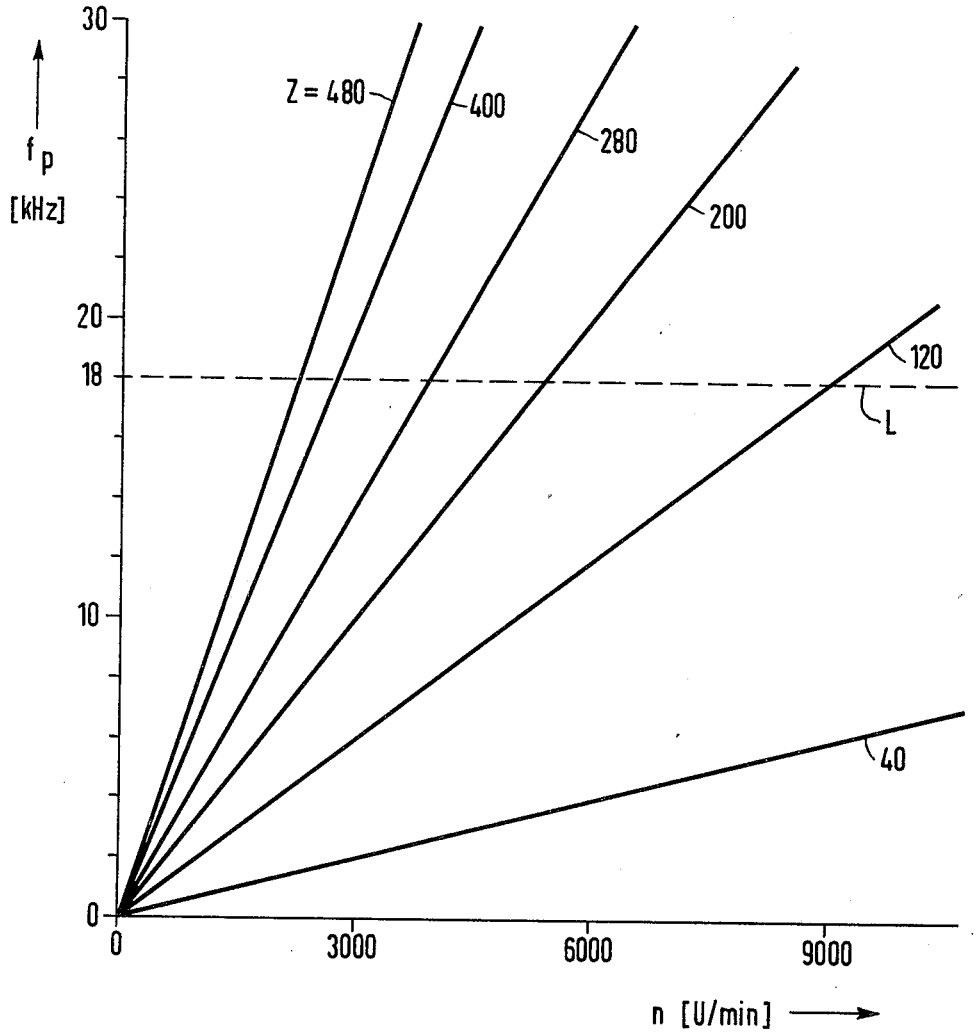
FIG. 1 shows the frequency of the sound pressure maximum of the pumped media of a ring compressor, plotted versus the speed $n$ of the impeller of the compressor, for different numbers of blades $z$ of such impeller.

FIG. 1 depicts the frequency $f_p$ of the sound pressure maximum of the pumped media of a ring compressor versus the operating speed $n$ of the impeller of the compressor for different numbers $z$ of impeller blades. In particular, the portions of the curves located above the dashed line L are of interest for realizing a compressor according to the invention. By locating the vibration maxima in such region, it is ensured that noise objectionable to human beings and caused by the passing of the impeller blades by the inlet and outlet openings of the compressor is substantially eliminated. On the other hand, such sound pressure levels, which are in the ultrasonic region, are not so high as to be above a frequency of 100 kHz, the latter frequency being a frequency which could lead to ear damage in humans.

Figure 2:
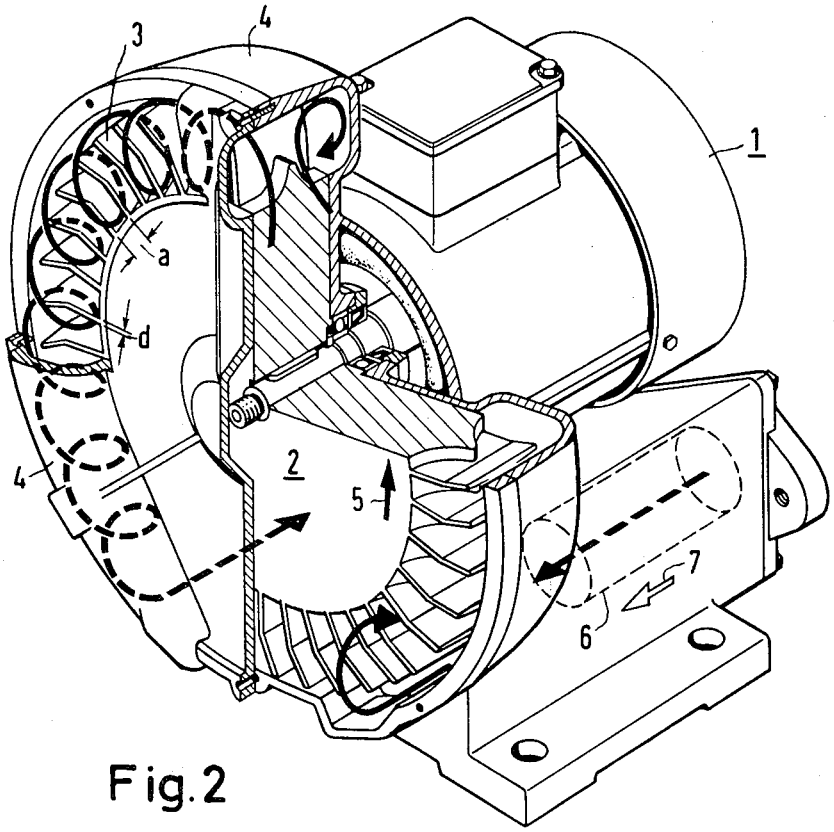
FIG. 2 illustrates, in schematic form, a side-channel ring compressor in accord with the invention.

As can be seen from FIG. 2, in which there is shown a ring compressor together with the drive motor 1, air is drawn into the compressor in the direction of the arrow 7 through an intake opening 6 and is conducted on a helical path along the impeller circumference, via the rotation of the impeller 2 in the direction of the arrow 5. In this manner, considerable pressure increases are obtained because of the repeated acceleration. The pumped medium then leaves the impeller blades through a pressure or outlet opening (not shown) which is adjacent to the intake opening. The impeller 2 with its blades 3 is additionally provided on both sides with means for guiding the air flow which are in the form of side canals 4. The latter canals, in turn, are interrupted by the inlet and the outlet openings. In accordance with the invention, the number $z$ of blades 3 is chosen so that the product of the blade number $z$ and the speed $n$ of the impeller 2 results in a sound pressure vibration at the inlet and outlet openings which is above the frequency range of human hearing. As an example, a particular design of the impeller might have the following parameters: a number of blades of 400, a speed of 3000, a blade spacing $a$ of less than 2 mm and a blade thickness $d$ of less than 0.5 mm and, preferably, of 0.3 mm.

In realizing the aforesaid design, it is noted that the conventional method of constructing the impeller by casting would present somewhat of a problem. As a result, the blade sheets which, for instance, might be 0.2 mm. thick, should be attached to the impeller hub by cementing or casting-in. It is also noted that the blade sheets should comprise a material which is as corrosion-resistant as possible, e.g., a stainless steel or plastic material, and should at the same time advantageously be elastic. Blade sheet materials of interest might, for instance, be the sheet steel used for razor blades.

Figure 3:
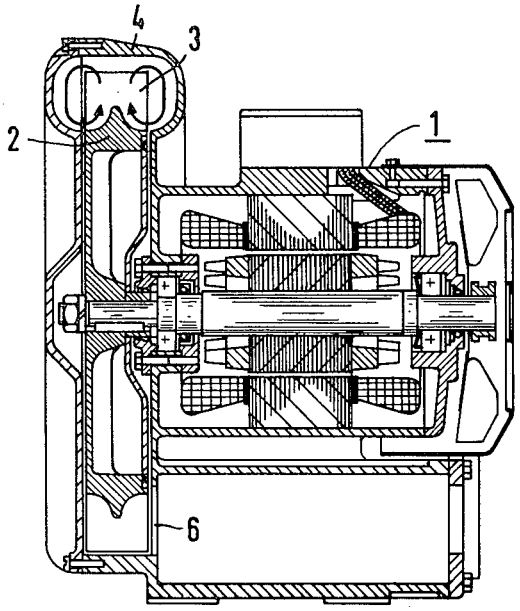
FIG. 3 shows a cross section through the side-channel ring compressor of FIG. 2.

The above-described design with relatively small blade spaces has the advantage that the noise itself is already substantially reduced by the damping in the relatively small blade chambers. In FIGS. 2 and 3, the illustrated impeller has been shown as having only a relatively few blades in order to promote clarity in describing the invention. Actually, as above indicated, one will have to choose a much larger number of blades than shown for a speed of, for instance, 3000 r.p.m.

As tests have shown, noise damping of up to 8dB can be achieved with the compressor of the present invention, while still realizing compression values such as can be obtained otherwise only by employing additional and expensive sound absorbers.

What is claimed is:

1. In a side-channel ring compressor for pumping a gaseous medium including an intake opening through which said medium enters said compressor, and a pressure opening out of which said medium leaves said compressor, the improvement comprising an impeller for pumping said medium and conducting said medium from said intake opening to said pressure opening, said impeller having a number of blades $z$ chosen so that the product thereof and the operating speed $n$ of the impeller is such that the vibration maxima of said medium at said intake and pressure openings have a frequency which lies above the hearing threshold frequency of the human ear and below 100 kHz.

2. A compressor as recited in claim 1 in which the spacing between said blades at the hub of said impeller is less than 2mm and the thickness of said blades is less than 0.5mm.

3. A compressor as recited in claim 1 in which said blades comprise a highly elastic material.

* * * * *